United States Patent [19]

Zedrosser

[11] Patent Number: 4,846,068

[45] Date of Patent: Jul. 11, 1989

[54] CARTRIDGE FOR FIREARMS

[75] Inventor: Ulrich Zedrosser, Steyr, Austria

[73] Assignee: Steyr-Daimler-Puch Aktiengesellschaft, Vienna, Austria

[21] Appl. No.: 68,955

[22] Filed: Jul. 1, 1987

[30] Foreign Application Priority Data

Jul. 8, 1986 [AT] Austria ..... 1845/86

[51] Int. Cl.[4] ..... F42B 5/02; F42B 5/30

[52] U.S. Cl. ..... 102/430; 102/434; 102/466; 102/470

[58] Field of Search ..... 102/430, 433, 434, 441, 102/443, 464–470

[56] References Cited

U.S. PATENT DOCUMENTS

| | | | |
|---|---|---|---|
| 1,470,591 | 10/1923 | Behar | 102/430 |
| 2,306,551 | 12/1942 | Maroney | 102/443 |
| 2,922,341 | 1/1960 | Treat, Jr. | 102/470 |
| 2,996,988 | 8/1961 | Kunz | 102/433 |
| 3,046,890 | 7/1962 | Dordick | 102/434 |
| 3,547,030 | 12/1970 | Kamp | 102/434 |
| 3,609,904 | 10/1971 | Scanlon | 102/466 |
| 3,760,729 | 9/1973 | Freeman | 102/466 X |
| 4,537,134 | 8/1985 | Galluzzi | 102/430 |

FOREIGN PATENT DOCUMENTS

| | | |
|---|---|---|
| 1958925 | 5/1971 | Fed. Rep. of Germany . |
| 2209459 | 9/1973 | Fed. Rep. of Germany . |
| 2320399 | 10/1974 | Fed. Rep. of Germany . |
| 2850879 | 6/1980 | Fed. Rep. of Germany . |
| 1571251 | 5/1969 | France . |

*Primary Examiner*—Harold J. Tudor

*Attorney, Agent, or Firm*—Marmorek, Guttman & Rubenstein

[57] ABSTRACT

A cartridge (1) comprises a cartridge case (2), which is closed at its rear end and contains a propellant charge (3) and a primer (7). The tip portion of the cartridge case defines a socket (4), which accommodates a full-bore projectile (5). The tip portion (2*b*), terminates adjacent to the nose of the projectile in an end face that is normal to the axis of the cartridge. That tip portion has an outside peripheral surface, which tapers with a substantially concave contour toward said forward end face. To provide a cartridge (1) which can easily be manufactured and can reliably be fired and can be gas-tightly inserted into the chamber of the firearm, the tip portion (2*b*) is formed in its rear end portion with a peripheral annular groove (6), which is open to the interior of the cartridge case and which contains the primer (7).

6 Claims, 1 Drawing Sheet

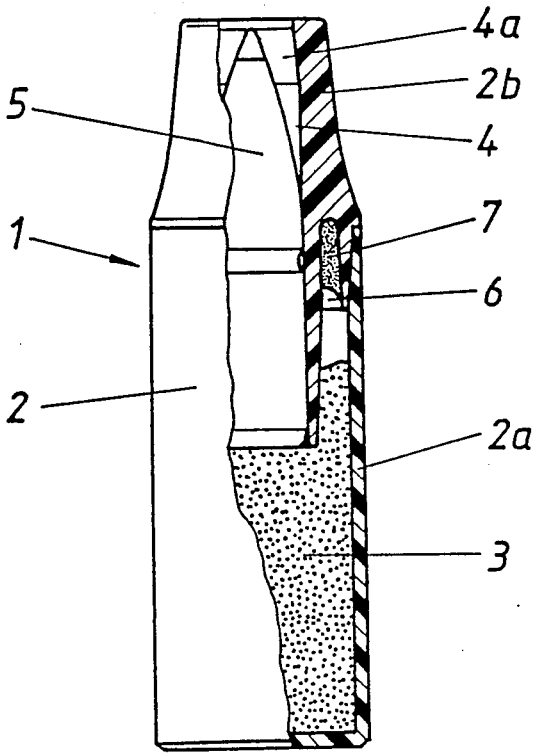
4a
2b
5
4
7
1
6
2
2a
3

CARTRIDGE FOR FIREARMS

BACKGROUND OF THE INVENTION

1. Field of the Invention

This invention relates to a cartridge for firearms comprising a plastic case which is closed at its rear end and comprises a propellant charge and a primer and has a tip portion defining a socket, which contains a full-bore projectile, wherein the socket-defining tip portion terminates adjacent to the nose of the projectile in a forward end face that is normal to the axis of the cartridge and said tip portion has an outside peripheral surface which tapers toward said end face with a concave contour.

2. Description of the Prior Art

Cartridge cases serve not only to interconnect and protect the projectile, propellant charge and primer but are particularly intended to provide a strong and centering mounting for the projectile and to contribute to the sealing of the chamber of the firearm as the propellant charge is fired and the round is discharged. To meet said requirements, most cases for live cartridges have previously been made of metal although this involves high manufacturing costs and a heavy weight of the cartridge. Attempts to use caseless cartridges have not been successful because the desired action of the cartridge cannot be ensured unless the case performs the protecting, guiding and sealing functions of the case because otherwise the firearm will be unreliable.

It has also been proposed to use a cartridge case which is made of plastic so that the advantages afforded by a cartridge case will be retained but the manufacturing costs and the weight of the cartridge can be reduced. In Published German Application No. 22 09 459 it has been proposed to make such plastic cases in the form of hollow cylinders, which are closed at their rear end and adjacent to that closed rear end contain the propellant charge and the primer. The projectile is provided with an externally threaded sheath and is screwed into the case from its open forward end until the nose of the projectile is also contained in the case. Owing to said manufacturing operations the manufacture is still rather expensive. Besides, the base primer requires a case to have a special base, which must have an adequate strength, and the base primer also requires the base to have a weak point, which may result in a leakage as the round is discharged.

SUMMARY OF THE INVENTION

It is an object of the invention to provide a cartridge which is of the kind described first hereinbefore and which ensures a reliable shooting performance and can be manufactured particularly economically, has no weak points at the base and particularly ensures a reliable priming.

That object is accomplished in accordance with the invention in that the tip portion of the cartridge case is formed its rear end portion with an annular peripheral groove, which is open toward the interior of the case and which contains the primer. As a result, the cartridge may be provided in its forward portion with an edge primer, which will cause the propellant charge to burn from its forward end to its base so that an ingress of unburnt powder of the propellant charge into the barrel bore as the round is discharged will be prevented and the action of the propellant charge will be increased. Because the edge primer extends around the socket, the projectile will confine the priming action, which is performed in that a suitable priming device sufficiently squeezes the primer, and special measures for providing such confining means are not required. The resulting cartridge is particularly simple but functionally reliable and has a case which is completely closed at its base so that leakage need not be feared.

In a preferred embodiment of the invention the inside surface of the tip portion tapers forwardly in conical shape adjacent to the forward end of the socket and the tip portion of the cartridge case preferably constitutes in known manner a tip member, which is separate from the case body and consists of plastic which is reinforced with glass fibers. Owing to that design of the cartridge case the socket is tapered at its open forward end so that a firm and tight fit of the projectile will be ensured and the projectile being propelled out of the case will expand the tip member so that its sealing action will be improved. If the tip portion is constituted by a separate tip member, the entire manufacturing sequence can be performed more efficiently and the case bodies can readily be combined with different tip members as may be desirable in the manufacture of live cartridges, blank cartridges, illuminating cartridges or the like. If the tip portion is constituted by a separate tip member, it may be sufficient to reinforce only that tip member with glass fibers so that a high strength for improving the holding and guiding of the projectile can be achieved with a low expenditure.

BRIEF DESCRIPTION OF THE DRAWING

The drawing is a diagrammatic side elevation showing partly in section an illustrative embodiment of a cartridge in accordance with the invention.

DETAILED DESCRIPTION OF THE PREFERRED EMBODIMENT

A cartridge 1 comprises a plastic cartridge case 2, which consists of two members, namely, a case body **2*a* and a tubular tip member 2*b*. The case body 2*a* contains a propellant charge 3. The tip member 2*b* defines a socket 4, which is open at its forward and rear ends and accommodates a full-bore projectile 5 as far as to the nose of the projectile. The tip member 2*b* terminates in a forward end face which generally extends in a plane that is normal to the axis of the cartridge. The outside peripheral surface of the tip member 2*b* tapers with a concave contour toward said forward end face. the inside surface of the tip member tapers forwardly in conical shape adjacent to the open forward end 4*a* of the socket. The tip member 2b is formed in its rear end portion with an annular peripheral groove 6, which surrounds the socket 4 and is axially overlapped by the case body 2*a* and is open toward the interior of the case body 2a. The groove 6 contains a primer 7, which constitutes an edge primer disposed in the forward portion of the cartridge. The tip member 2*b*, the projectile 5 and the edge primer 6, 7 constitute a separate unit, which in the manufacture of the cartridge said unit 2*b*, 5, 6, 7 is adhesively joined or is welded to the case body 2*a*, which accommodates the propellant charge 3**.

The projectile 5 accommodated in the cartridge case 2 is substantially projected from external stresses so that the cartridge case may be made of plastic. The tip member **2*b*, which defines the socket 5 accommodating the projectile 5, may be designed to have a large wall thickness, which will ensure the required strength. The rear end portion of the tip member 2b comprises a tubular extension, which contains the rear portion at the projectile 5 and protrudes rearwardly beyond the groove 6 into the case body 2a and defines an annular clearance therewith. The annular groove 6 opens rearwardly into said annular clearance, which is filled in part by a portion of the propellant charge 3. Because said tubular extension defines the rear portion of the socket 4, the socket 4 is sufficiently long and provides for a reliable retention of the projectile 5 and for an effective centering guidance of the projectile 5 and also ensures a tight seal for the propellant charge 3. The primer 7 provided in the tip member 2b will ensure a complete combustion of the propellant charge 3 within the case body 2a so that the cartridge 1 will be particularly effective. Besides, the specially shaped tip member 2b** will perform an important sealing in the chamber of the firearm and will also ensure that the cartridge will effect a perfectly gas-tight seal as the round is discharged.

I claim:

1. A cartridge for firearms, comprising a cartridge case having a longitudinal axis and made from a synthetic material, said cartridge case having a closed rear end and a tubular tip portion, said tip portion being formed with a forward end face and a rear end portion, said forward end face generally extending in a plane that is normal to said axis, said tip portion having an outside peripheral surface which tapers concave toward said forward end face, said tip portion defining in its interior a socket which is open at said forward end face, a full bore projectile fitted in said socket and having a nose adjacent to said forward end face, a propellant charge contained in said cartridge case, a primer contained in said cartridge case adjacent to and communicating with said propellent charge, said tip portion being formed in said rear end portion with a peripheral annular groove, which is open to the interior of said cartridge case and contains said primer, and said tip portion having an inside peripheral surface which defines said socket and adjacent to said forward end tapers forwardly in conical shape.

2. The cartridge set forth in claim 1 wherein said cartridge case comprises a tip member and a case body, said tip member including said tip portion and being made from a glass fiber-reinforced plastic, said case body being joined to said tip member and containing said propellant charge.

3. The cartridge set forth in claim 2, wherein said case body axially overlaps and surrounds said rear end portion of said tip member and said annular groove opens rearwardly into the interior of said case body.

4. The cartridge set forth in claim 3, wherein said rear end portion of said tip member comprises a tubular extension which defines part of said socket and extends rearwardly beyond said groove into said case body and defines an annular clearance therewith, said annular groove opens rearwardly into said annular clearance, and said annular clearance contains a portion of said propellant charge.

5. The cartridge set forth in claim 2, wherein said case body consists of unreinforced plastic material.

6. A cartridge case for firearms, which cartridge case defines a longitudinal axis and has a closed rear end and a tubular tip portion, which is formed with a forward end face, which generally extends in a plane that is normal to said axis, and with a rear end portion and has an outside peripheral surface which tapers toward said forward end face with a substantially tapered contour, wherein said tip portion defines in its interior a socket, which is open at said forward end face and at the rear, wherein said socket is dimensioned to accommodate a full-bore projectile having a nose adjacent to said forward end face and said cartridge case is adapted to contain a propellant charge, said tip portion being formed in said rear end portion with a peripheral annular groove, which is open to the interior of said cartridge case and is so dimensioned and positioned as to receive a primer in operative position.

* * * * *